US012279705B1

(12) United States Patent
Porcaro, Jr.

(10) Patent No.: US 12,279,705 B1
(45) Date of Patent: Apr. 22, 2025

(54) JEWELRY DISPLAY CARD

(71) Applicant: Felix A. Porcaro, Jr., Jamestown, RI (US)

(72) Inventor: Felix A. Porcaro, Jr., Jamestown, RI (US)

(73) Assignee: Uncas International LLC, West Warwick, RI (US)

( * ) Notice: Subject to any disclaimer, the term of this patent is extended or adjusted under 35 U.S.C. 154(b) by 15 days.

(21) Appl. No.: 18/385,466

(22) Filed: Oct. 31, 2023

(51) Int. Cl.

| | |
|---|---|
| ***A45C 11/04*** | (2006.01) |
| ***A47F 3/00*** | (2006.01) |
| ***A47F 7/02*** | (2006.01) |
| *A45C 11/16* | (2006.01) |
| *A45C 15/06* | (2006.01) |

(52) U.S. Cl.
CPC ..... *A47F 7/02* (2013.01); *A47F 3/001* (2013.01); *A45C 11/16* (2013.01); *A45C 15/06* (2013.01)

(58) Field of Classification Search
CPC . A45C 11/16; A45C 15/06; A47F 7/02; A47F 3/001
USPC ..... 206/6.1, 495, 566, 806; 362/104
See application file for complete search history.

(56) References Cited

U.S. PATENT DOCUMENTS

| | | | | |
|---|---|---|---|---|
| 3,694,644 | A * | 9/1972 | Bauknight | B42F 9/004 362/274 |
| 3,697,737 | A * | 10/1972 | Levkoff | B42D 5/006 362/802 |
| 3,885,145 | A * | 5/1975 | Wise | F21V 33/0048 362/183 |
| 3,937,320 | A * | 2/1976 | Chao | A45C 15/06 206/418 |
| 4,290,093 | A * | 9/1981 | Thompson | F21S 9/02 362/427 |
| 5,709,297 | A | 1/1998 | Brandriff et al. | |
| 6,231,205 | B1 | 5/2001 | Slesinger et al. | |
| 6,302,558 | B1 | 10/2001 | Parks | |
| 6,844,686 | B1 | 1/2005 | Schneck et al. | |
| 7,163,307 | B1 * | 1/2007 | Clark | B43L 3/001 40/661.02 |
| 7,950,819 | B2 | 5/2011 | Wells | |
| 8,730,035 | B2 | 5/2014 | Nagashima et al. | |
| 9,743,494 | B1 | 8/2017 | McCrory et al. | |
| 10,244,840 | B2 | 4/2019 | Zhu et al. | |
| 10,653,331 | B2 | 5/2020 | Stewart | |
| 2005/0152133 | A1 * | 7/2005 | Kao | A45C 15/06 362/155 |
| 2007/0115653 | A1 * | 5/2007 | Cea | A45C 15/06 362/104 |
| 2008/0251396 | A1 * | 10/2008 | Oh | A45C 11/16 206/6.1 |

(Continued)

*Primary Examiner* — Luan K Bui
(74) *Attorney, Agent, or Firm* — Salter & Michaelson

(57) ABSTRACT

A jewelry display card for displaying jewelry items and comprised of a lower card section and an upper enclosure section. The lower card section is for receiving on an outwardly facing display surface thereof and displaying, the jewelry item. The upper enclosure section is in the form of a multi-sided hollow chamber that is defined in part by a lower facing wall surface. A light source extends through a hole in the lower facing wall surface so as to direct light from the light source downward on the outwardly facing display surface of the lower card section. A battery is connected to and for powering the light source.

18 Claims, 9 Drawing Sheets

(56) References Cited

U.S. PATENT DOCUMENTS

2009/0200183 A1* 8/2009 Dussin ..... A47F 7/03
206/6.1

* cited by examiner

JEWELRY DISPLAY CARD

TECHNICAL FIELD

The present invention relates in general to a jewelry display device. More particularly, the present invention relates to a simplified jewelry display card in which jewelry items can be displayed and illuminated.

BACKGROUND OF THE INVENTION

There are various ways of displaying jewelry items for sale. This would include such items as earrings and necklaces. One typical means of display is using a jewelry case. However, this can become an expensive way of displaying jewelry items.

Accordingly, it is an object of the present invention to provide an improved jewelry display device, and in particular, in the form of a jewelry display card.

Another object of the present invention is to provide an improved jewelry display card that is simple in construction and that provides an effective way of displaying jewelry items.

Still another object of the present invention is to provide a jewelry display card in which the jewelry item is, not only displayed, but also effectively illuminated for display purposes.

SUMMARY OF THE INVENTION

To accomplish the foregoing and other objects and features of the present invention there is provided a jewelry display card for displaying jewelry items and comprised of a lower card section and an upper enclosure section, the lower card section for receiving on an outwardly facing display surface thereof and displaying the jewelry item. The upper enclosure section is in the form of a multi-sided hollow chamber that is defined in part by a lower facing wall surface. A light source extends through a hole in the lower facing wall surface so as to direct light from the light source downward on the outwardly facing display surface of the lower card section. A battery is connected to and for powering the light source.

In accordance with other aspects of the present invention the outwardly facing display surface of the lower card section is planar and includes a fastener for securing the jewelry item to the outwardly facing display surface of the lower card section; including a circuit board that is disposed in the multi-sided hollow chamber for supporting the light source and battery; including a motion detector associated with the circuit board and for detecting any movement of the jewelry display card; including a timer that is responsive to the action of the motion detector for controlling an illumination of the light source for a predetermined time interval; wherein the timer is a monostable multi-vibrator that has a set "on" time and that is responsive to the detection of motion by the motion detector; wherein the set "on" time is in a range of 5-7 seconds.

In accordance with still other aspects of the present invention there is provided a pull tab that extends to a battery surface in order to interrupt a circuit between the battery and the light source until the pull tab is released and permits completion of the circuit; the multi-sided hollow chamber is also defined in part by an upper facing wall surface that has a slit for receiving the pull tab; wherein the light source is an LED and the battery is circular in shape; including a pull tab that extends to a battery surface in order to interrupt a circuit between the battery and the LED until the pull tab is released and permits completion of the circuit; and wherein the lower facing wall surface extends transverse to the outwardly facing display surface of the lower card section.

In accordance with another variation of the present invention there id provided a method of constructing a jewelry display card for displaying jewelry items and including a lower card section and an upper enclosure section, the lower card section having an outwardly facing display surface for displaying the jewelry item. The method provides that the upper enclosure section is formed by means of a card blank having multiple side walls including ay least three parallel arranged side walls that are folded relative to each other to form a multi-sided hollow chamber that is defined in part by a lower facing wall surface, mounting a light source that extends through a hole in the lower facing wall surface so as to direct light from the light source downward on the outwardly facing display surface of the lower card section, and providing a battery connected to and for powering the light source.

In accordance with other aspects of the present invention providing an upper facing wall surface having a slit for receiving a pull tab that initially prevents activation of the light source from the battery; including sensing a motion of the jewelry display card to activate the light source; and providing the outwardly facing display surface of the lower card section as being planar and providing a fastener for securing the jewelry item to the outwardly facing display surface of the lower card section.

In accordance with still another variation of the present invention there is provided a jewelry display card for displaying jewelry items and comprised of a lower card section and an upper enclosure section. The lower card section is for receiving on an outwardly facing display surface thereof and displaying the jewelry item. The upper enclosure section forms a multi-sided hollow chamber that is defined in part by a lower facing wall surface. A powered light source extends through a hole in the lower facing wall surface so as to direct light from the light source downward on the outwardly facing display surface of the lower card section. The multi-sided hollow chamber includes at least three parallel arranged side walls that are folded relative to each other to form the multi-sided hollow chamber and that further comprises an upper facing wall surface having a slit for receiving a pull tab that initially prevents activation of the light source from the battery. Also, the lower facing wall and upper facing wall are preferably disposed in parallel and the lower facing wall surface extends transverse to the outwardly facing display surface of the lower card section.

BRIEF DESCRIPTION OF THE DRAWINGS

It should be understood that the drawings are provided for the purpose of illustration only and are not intended to define the limits of the disclosure. The foregoing and other objects and advantages of the embodiments described herein will become apparent with reference to the following detailed description when taken in conjunction with the accompanying drawings in which.

DETAILED DESCRIPTION

Reference is now made to a preferred embodiment of the jewelry display card in accordance with the principles of the present invention. Refer, in particular, to FIGS. 1-6.

Figure 1:
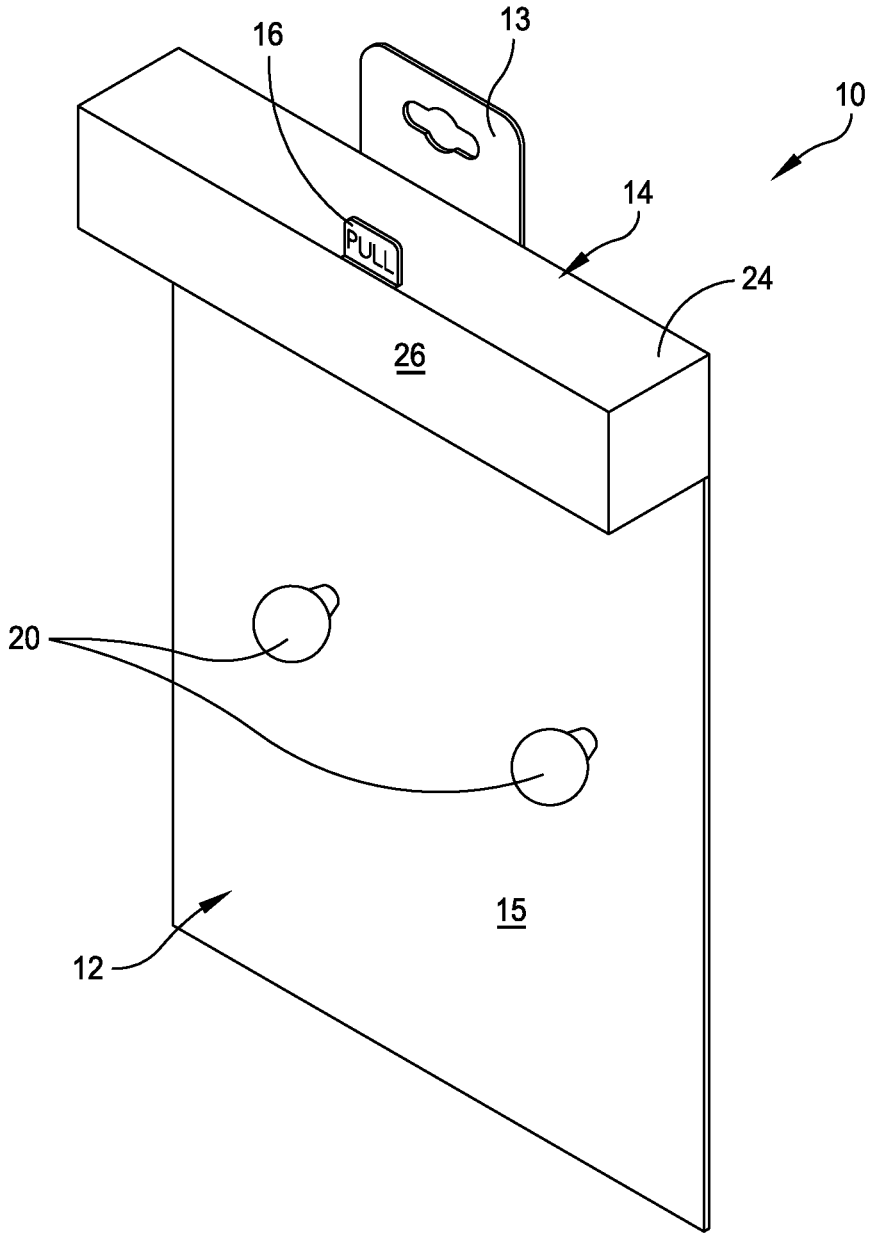
FIG. 1 is a front perspective view of one embodiment in accordance with the present invention.
Figure 2:
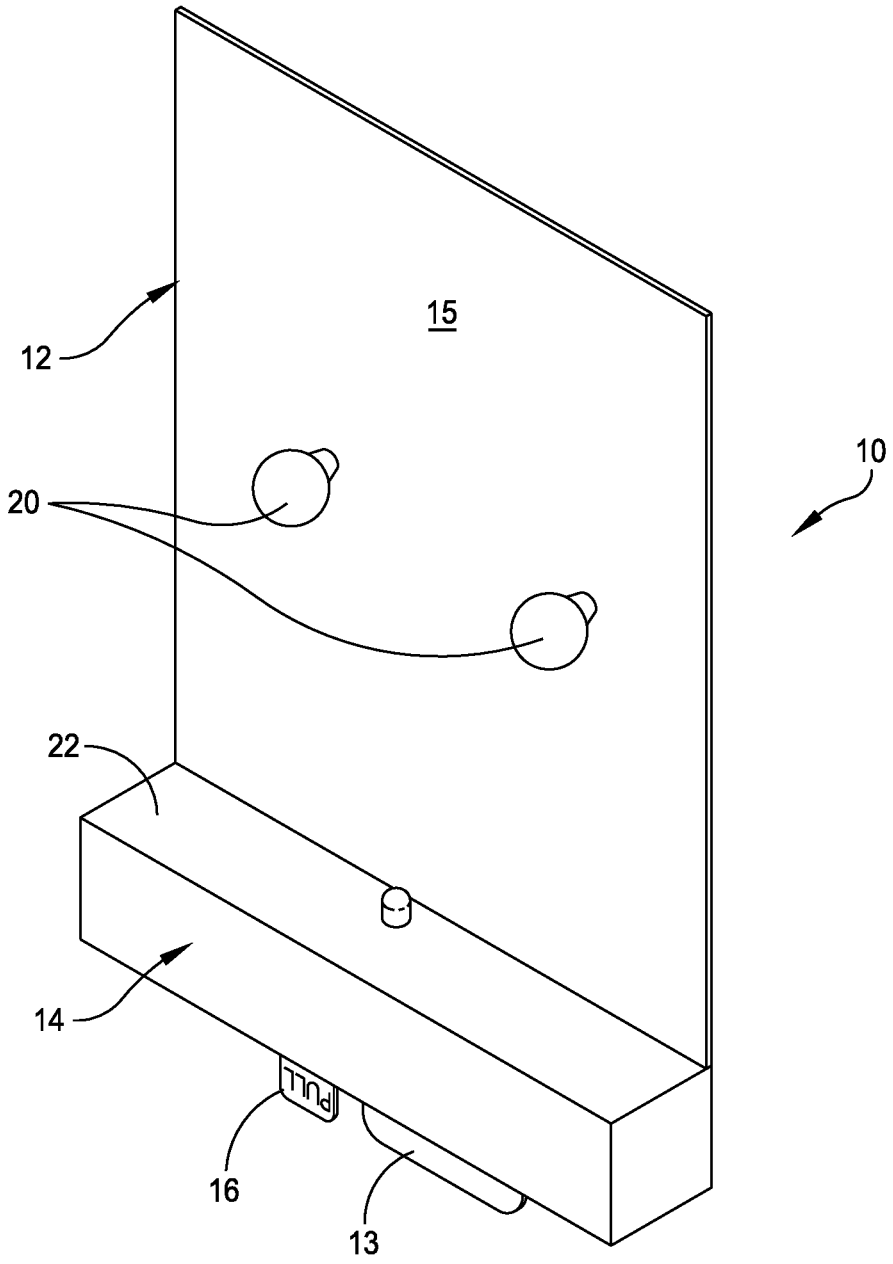
FIG. 2 is a front perspective view taken from the bottom.
Figure 3:
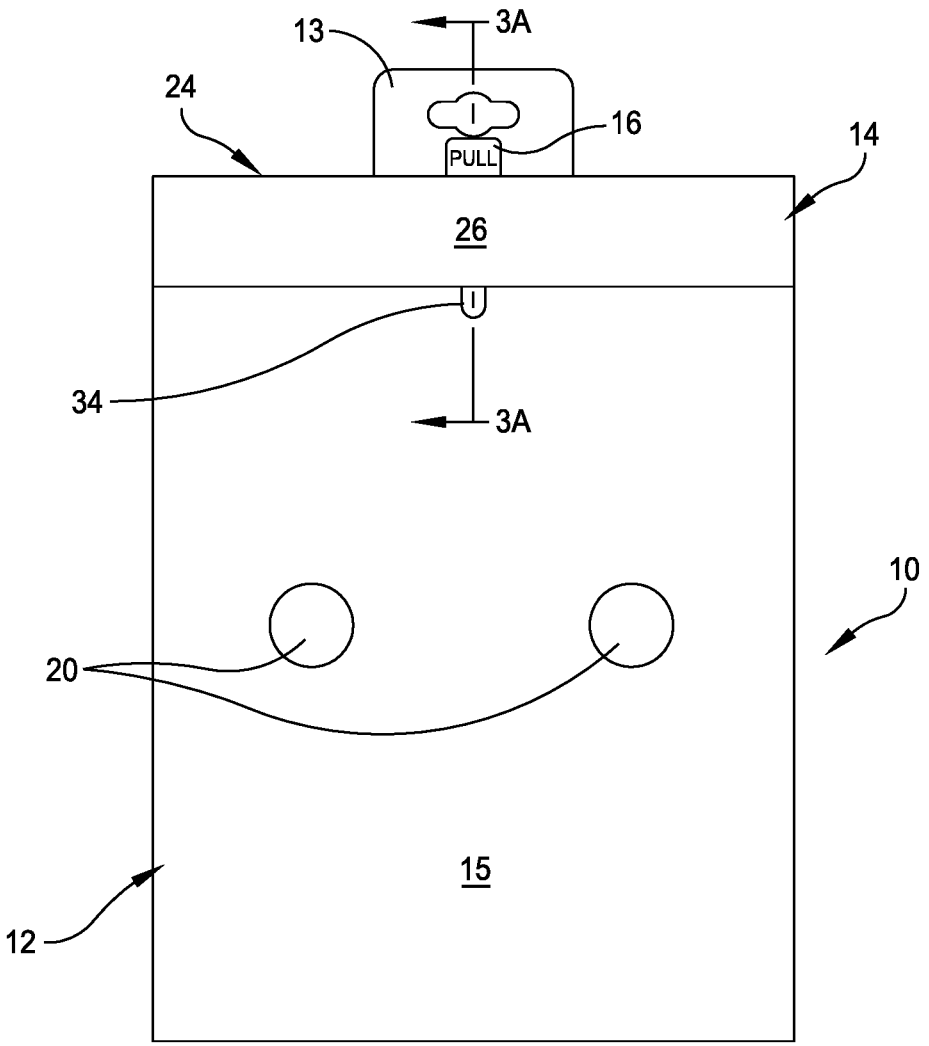
FIG. 3 is a front view.

The drawings illustrate a jewelry display card 10 that may be considered as including a lower card section 12 and an upper enclosure section 14. The lower card section 12 is for receiving, on an outer facing display surface 15, a jewelry item 20. Refer, for example, to FIGS. 1 and 3 that illustrate the outwardly or forwardly facing display surface 15. Also illustrated is a jewelry item 20. If the jewelry item was a pair of earrings, they could be secured through the card with a clutch being provided on the backside of the display card. Chains, pendants or necklaces could be attached to a fold-over closer to the top of the display card.

Figure 12:
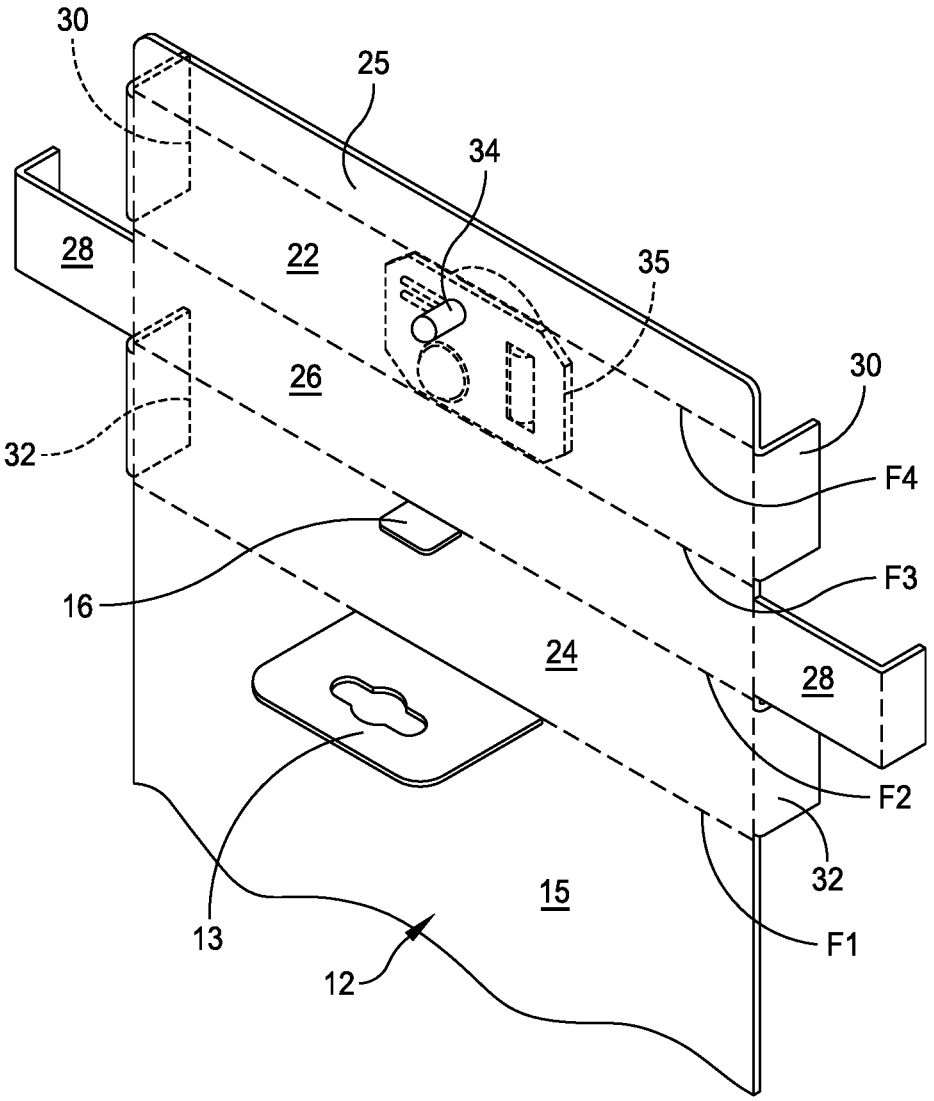
FIG. 12 illustrates the blank with the circuit card in position.
Figure 13:
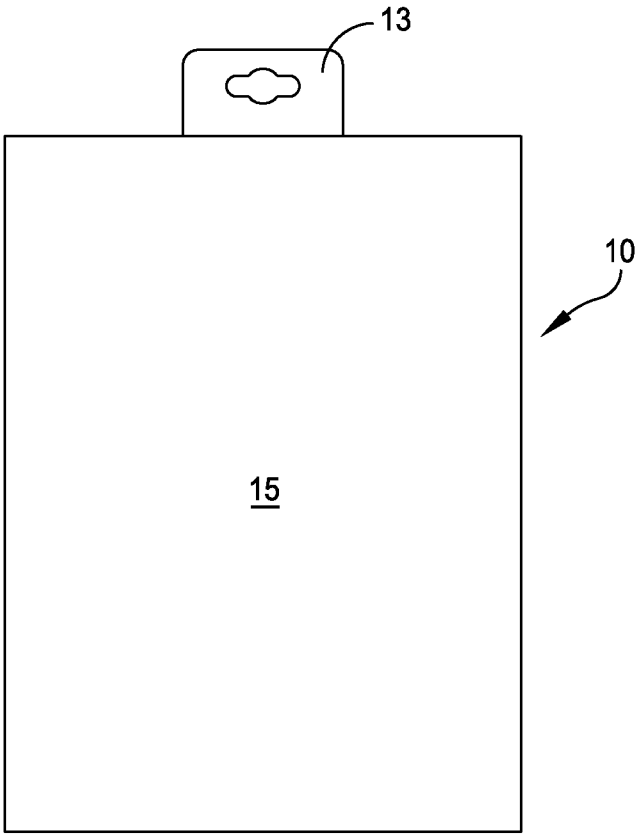
FIG. 13 is a front view.
Figure 14:
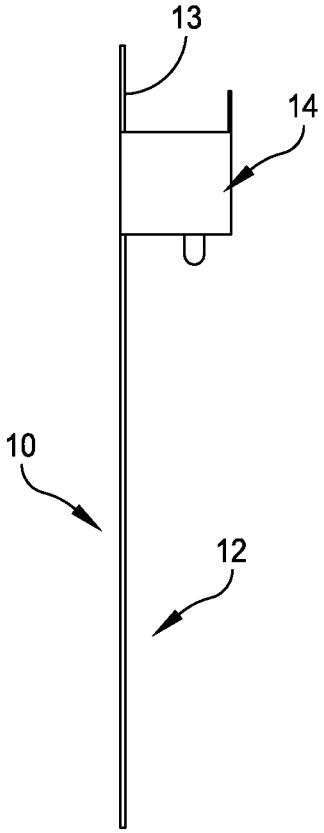
FIG. 14 is a left side view.
Figure 15:
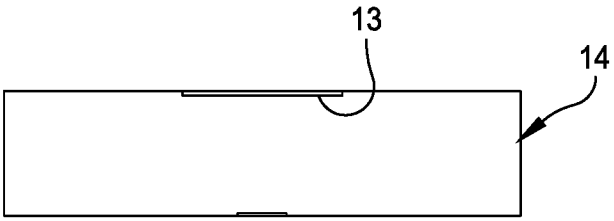
FIG. 15 is a top view.
Figure 16:
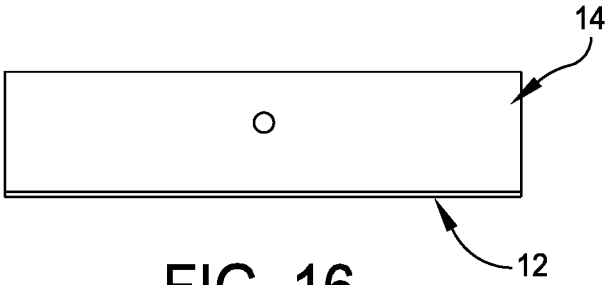
FIG. 16 is a bottom view.

The upper enclosure section 14 forms a multi-sided hollow chamber 18 that is defined in part by a series of walls 22, 24, 25 and 26 including a lower facing wall surface 22. Disposed within the chamber 18 is a light source that is preferably in the form of an LED 34. The wall surface 22 is provided with a hole at 23 for accommodating the LED. Refer in particular to FIG. 12 that shows the LED 34 extending through the hole. Also, refer in particular to the cross-sectional view of FIG. 3A that shows the LED extending through the wall 22 and extending in a downward direction. Refer also to the front view of FIG. 3 where the LED 34 is shown. The LED is in a position to direct light at the jewelry item 20.

Figure 3A:
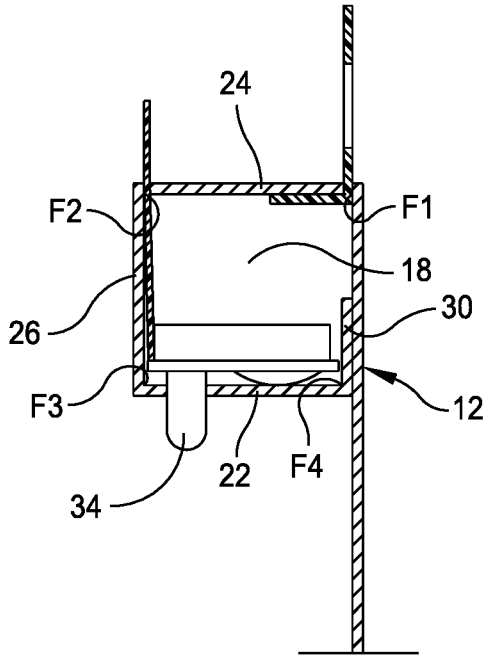
FIG. 3A is a cross-sectional view taken along line 3A-3A of FIG. 3.
Figure 3B:
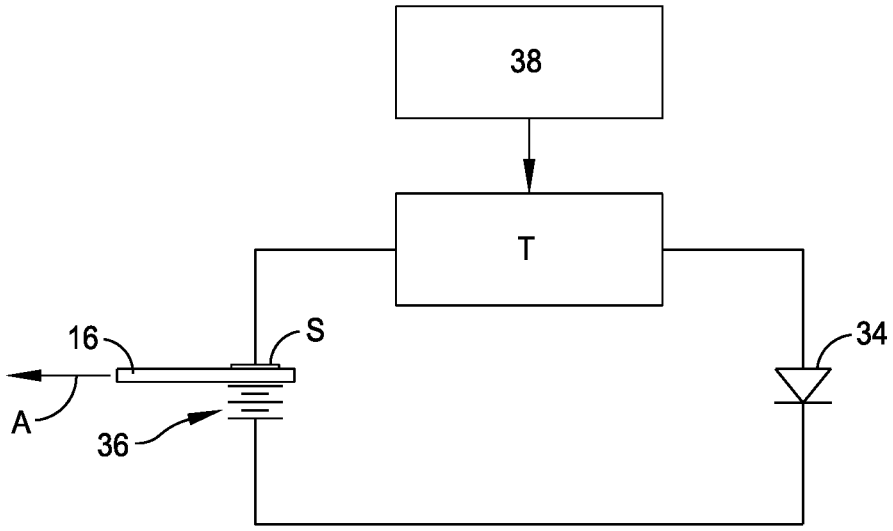
FIG. 3B is a schematic circuit diagram useful in explaining the invention.
Figure 4:
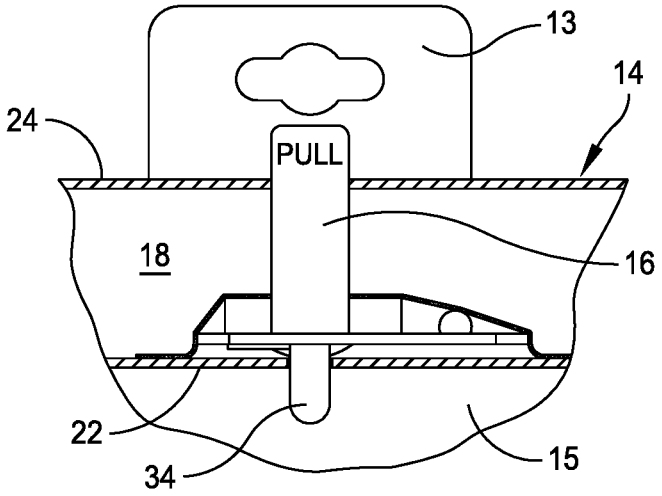
FIG. 4 is an enlarged partial cross-sectional front view with the pull tab in place.
Figure 5:
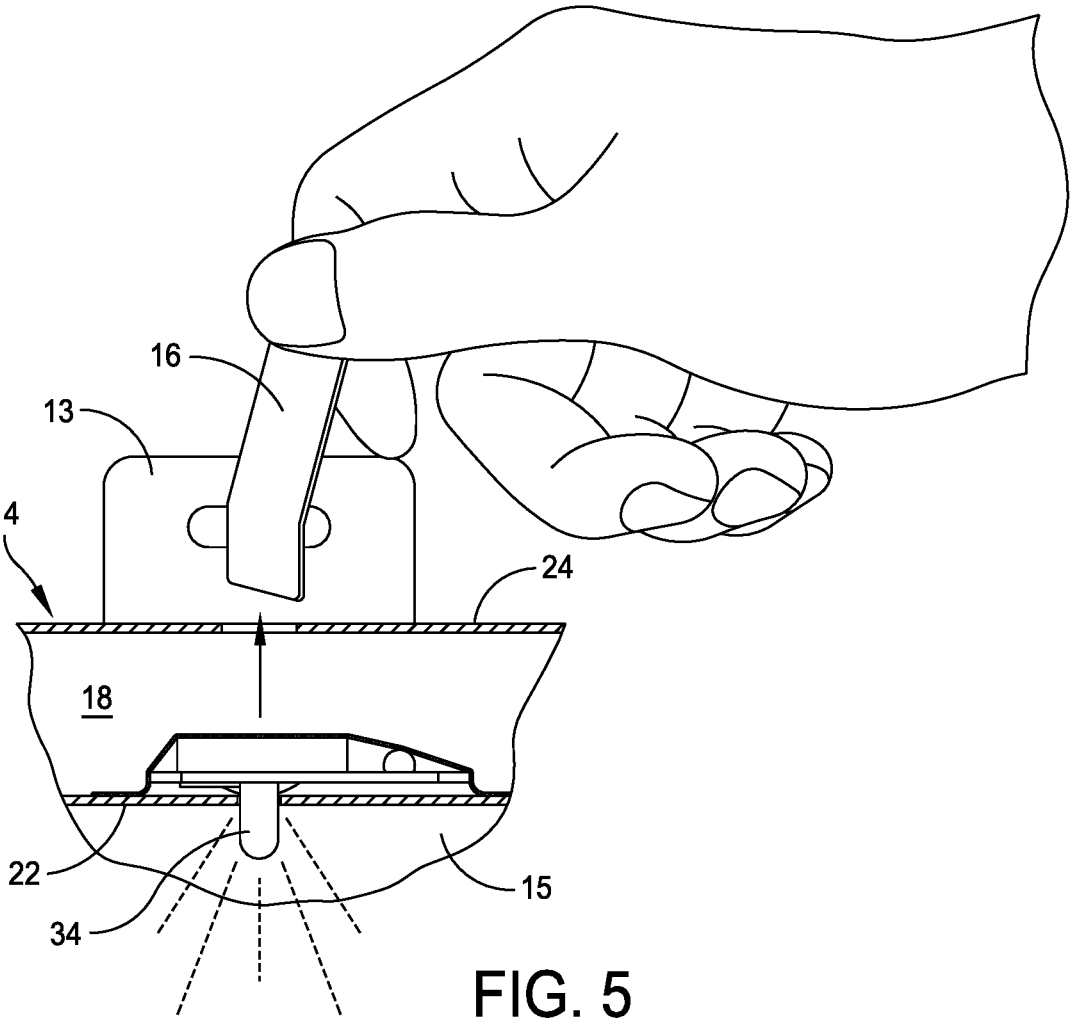
FIG. 5 is an enlarged partial front view showing the pull tab being extracted.

Also illustrated in the preferred embodiment is the use of a hanging strip such as disclosed at 13 in FIGS. 1 and 3. This hanging strip may be used for supporting the jewelry display card from a wall or other surface. Also illustrated in the preferred embodiment is the use of a pull tab 16. The pull tab 16 extends to the surface of the battery 36 and provides an insulation member that would prevent the light from being illuminated. In this regard, refer to the simplified circuit diagram of FIG. 3B where the pull tab 16 is shown disposed between some type of a biasing spring S and the battery 36. As long as the pull tab is in place as illustrated in FIG. 3B then the circuit between the battery and the LED 34 is interrupted. When the pull tab 16 is removed, as in the direction of arrow A in FIG. 3B, then the circuit is completed.

In accordance with the present invention, the outwardly facing display surface 15 of the lower card section 12 is preferably planar and would include some type of a fastener for securing the jewelry item to the outwardly facing display surface 15. This fastener may be in the form of a clutch for earrings or a fold-over.

Refer, in particular, to FIGS. 7-11 for various views of the circuit board 35. For example, FIGS. 7 and 9 also illustrate the LED at 34, the battery at 36 and a motion detector at 38. The motion detector is preferably associated with a circuit board and detects any movement of the jewelry display card. In this way, if the card is picked up to observe the jewelry item, as soon as the card is moved, the motion detector senses the movement and causes the LED to be illuminated for some predetermined period of time. This predetermined period of time may be, for example, 5-7 seconds. In this regard, refer also to the circuit diagram of FIG. 3B that shows a timer T receiving a signal from the motion detector 38, the timer T may be in the form of a monostable multi-vibrator that has a set "on" time and that is responsive to the detection of motion by the motion detector.

Figure 6:
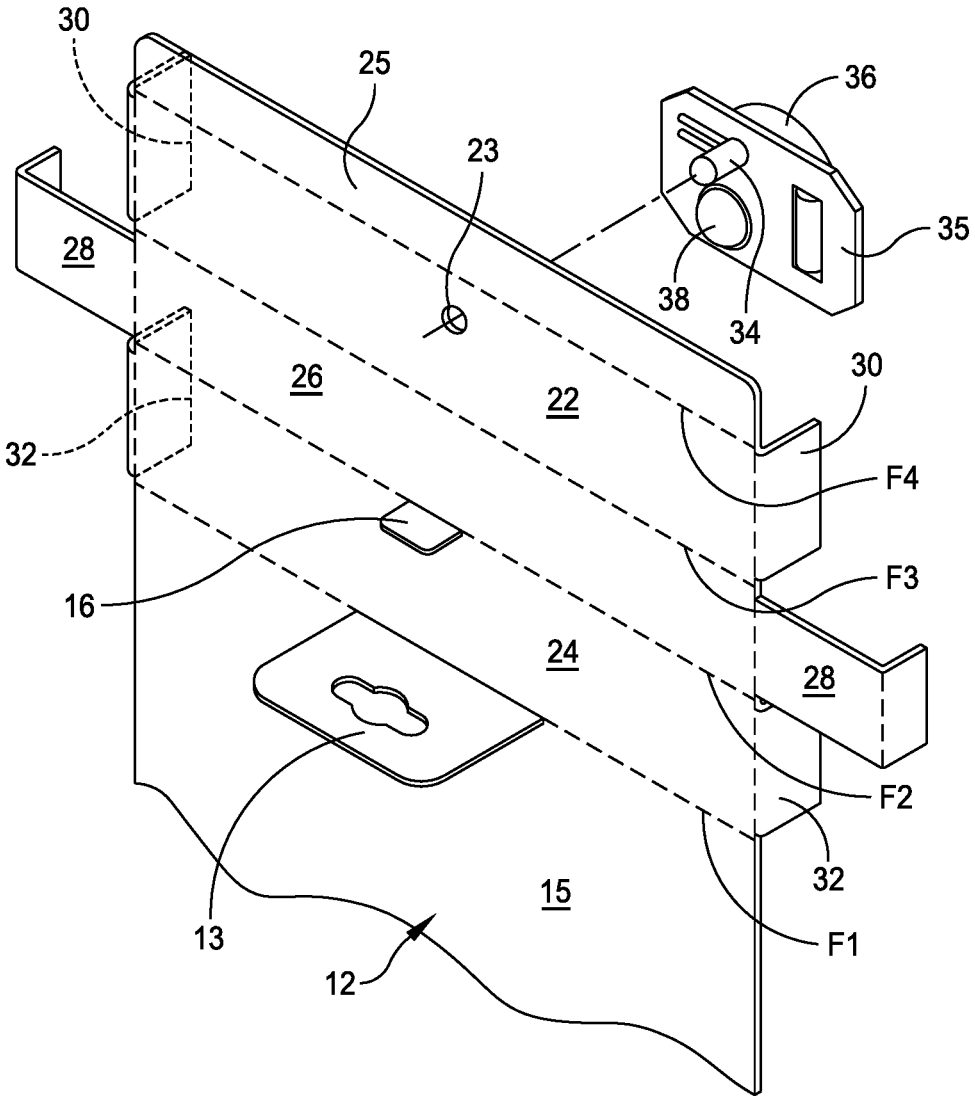
FIG. 6 is a partial perspective view of the blank that is used in constructing the jewelry display card.
Figure 7:
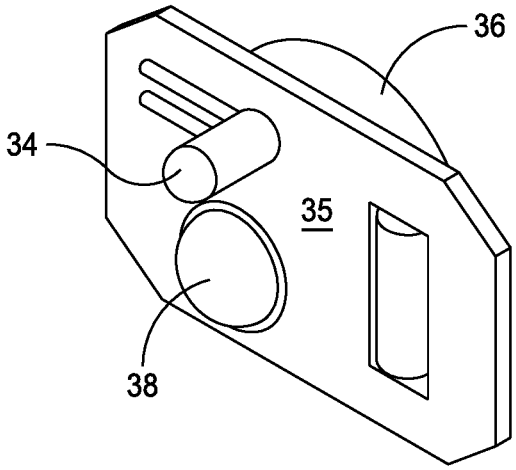
FIG. 7 is a perspective view of the circuit card.
Figure 8:
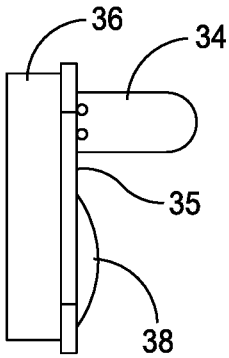
FIG. 8 is a left view of the circuit card.
Figure 9:
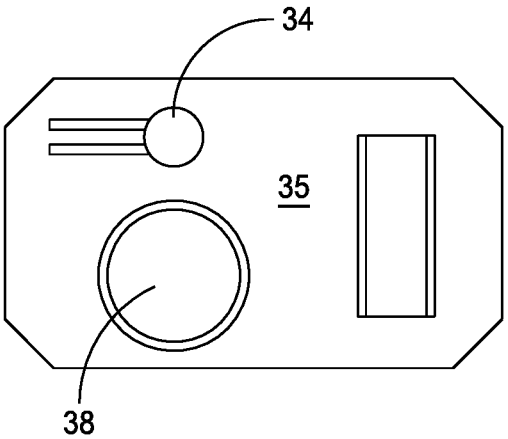
FIG. 9 is a front view of the circuit card.
Figure 10:
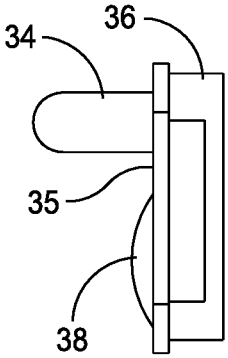
FIG. 10 is a left side view of the circuit card.
Figure 11:
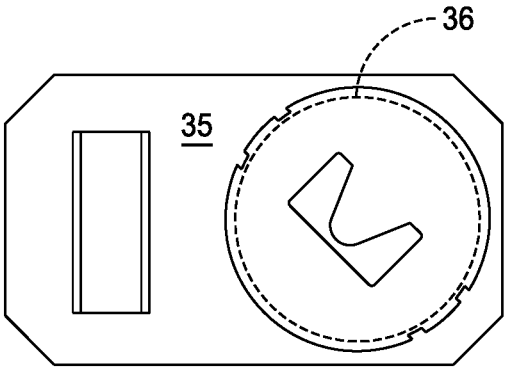
FIG. 11 is a is a rear view of the circuit card.

In accordance with another aspect of the present invention there is provided a method of constructing a jewelry display card for displaying jewelry items in which the display card has a lower card section and an upper enclosure section. The lower card section has an outwardly facing display surface 15 for displaying the jewelry item 20. The method comprises the steps of providing the upper enclosure section formed by means of a card blank having multiple side walls including at least three parallel arranged side walls that are folded relative to each other to form a multi-sided hollow chamber. These walls include the lower facing wall surface 22, the upper facing wall surface 24, the front facing wall surface 26, and an end wall 25. In this regard, refer in particular to FIGS. 6 and 12. Where the various walls are disclosed. FIG. 6 also illustrates by dashed lines where the folds occur between these various wall sections. These are identified as fold lines F1 through F4. These fold lines are also illustrated in the cross-sectional view of FIG. 3A. FIG. 6 illustrates the blank while FIG. 3A illustrates the final position forming the hollow chamber 18.

As indicated previously, the jewelry display card is an effective means by which a jewelry item can be displayed such as on the surface 15 in FIG. 1. While at the same time providing for the illumination of the items such as illustrated in the front view of FIG. 3 once the pull tab 16 has been released. In order to reduce the drain on the battery, the illumination occurs only for a predetermined amount of time as determined by the timer T illustrated in FIG. 3B.

REFERENCE NUMBERS jewelry display card 10
lower card section 12
hanging strip 13
upper enclosure section 14
outwardly facing display surface 15
pull tab 16
pull tab slit 17
multi sided hollow chamber 18
jewelry item 20
lower facing wall surface 22
hole in surface 22 23
upper facing wall surface 24
end wall 25
front facing wall surface 26
side wall ends 28
end tabs 30
end tabs 32
LED 34 circuit board 35
battery 36
motion detector 38
logic 40
fold lines F1-F4
timer T
bias spring S

Having now described a limited number of embodiments of the present invention, it should now be apparent to those skilled in the art that numerous other embodiments and modifications thereof are contemplated as falling within the scope of the present invention, as defined by the appended claims.

What is claimed is:

1. A jewelry display card for displaying jewelry items and comprised of a lower card section and an upper enclosure section, the lower card section for receiving on an outwardly facing display surface thereof and displaying the jewelry item, the upper enclosure section forming a multi-sided hollow chamber that is defined in part by a lower facing wall surface, a light source that extends through a hole in the lower facing wall surface so as to direct light from the light source downward on the outwardly facing display surface of the lower card section, a battery connected to and for powering the light source including a circuit board that is disposed in the multi-sided hollow chamber for supporting the light source and battery and a motion detector associated with the circuit board and for detecting any movement of the jewelry display card.

2. The jewelry display card of claim 1 wherein the outwardly facing display surface of the lower card section is planar and includes a fastener for securing the jewelry item to the outwardly facing display surface of the lower card section.

3. The jewelry display card of claim 1 including a timer that is responsive to the action of the motion detector for controlling an illumination of the light source for a predetermined time interval.

4. The jewelry display card of claim 3 wherein the timer is a monostable multi-vibrator that has a set "on" time and that is responsive to the detection of motion by the motion detector.

5. The jewelry display card of claim 3 wherein the set "on" time is in a range of 5-7 seconds.

6. The jewelry display card of claim 4 including a pull tab that extends to a battery surface in order to interrupt a circuit between the battery and the light source until the pull tab is released and permits completion of the circuit.

7. The jewelry display card of claim 5 wherein the multi-sided hollow chamber is also defined in part by an upper facing wall surface that has a slit for receiving the pull tab.

8. The jewelry display card of claim 7 wherein the multi-sided hollow chamber is also defined by a contiguous front wall.

9. The jewelry display card of claim 1 wherein the light source is an LED and the battery is circular in shape.

10. The jewelry display card of claim 1 including a pull tab that extends to a battery surface in order to interrupt a circuit between the battery and the LED until the pull tab is released and permits completion of the circuit.

11. The jewelry display card of claim 1 wherein the lower facing wall surface extends transverse to the outwardly facing display surface of the lower card section.

12. A method of constructing a jewelry display card for displaying jewelry items and including a lower card section and an upper enclosure section, the lower card section having an outwardly facing display surface for displaying the jewelry item, said method comprising providing the upper enclosure section formed by means of a card blank having multiple side walls including at least three parallel arranged side walls that are folded relative to each other to form a multi-sided hollow chamber that is defined in part by a lower facing wall surface, mounting a light source that extends through a hole in the lower facing wall surface so as to direct light from the light source downward on the outwardly facing display surface of the lower card section, and providing a battery connected to and for powering the light source.

13. The method of claim 12 including providing an upper facing wall surface having a slit for receiving a pull tab that initially prevents activation of the light source from the battery.

14. The method of claim 12 including sensing a motion of the jewelry display card to activate the light source.

15. The method of claim 14 wherein the multi-sided hollow chamber is also defined by a contiguous front wall.

16. The method of claim 13 including providing the outwardly facing display surface of the lower card section as being planar and providing a fastener for securing the jewelry item to the outwardly facing display surface of the lower card section.

17. A jewelry display card for displaying jewelry items and comprised of a lower card section and an upper enclosure section, the lower card section for receiving on an outwardly facing display surface thereof and displaying the jewelry item, the upper enclosure section forming a multi-sided hollow chamber that is defined in part by a lower facing wall surface, a powered light source that extends through a hole in the lower facing wall surface so as to direct light from the light source downward on the outwardly facing display surface of the lower card section, said multi-sided hollow chamber including at least three parallel arranged side walls that are folded relative to each other to form the multi-sided hollow chamber and that further comprises an upper facing wall surface having a slit for receiving a pull tab that initially prevents activation of the light source from the battery.

18. The jewelry display card of claim 17 wherein the lower facing wall and upper facing wall are disposed in parallel and wherein the lower facing wall surface extends transverse to the outwardly facing display surface of the lower card section.

* * * * *